United States Patent [19]

Evans et al.

[11] 4,359,886

[45] Nov. 23, 1982

[54] KEY LOCK CYLINDER FOR POSSIBLY CONTAMINATED ENVIRONMENTS

[75] Inventors: Walter R. Evans, Lancaster; Gary R. Murphree, Lexington; Shelly M. Osborne, Nicholasville, all of Ky.

[73] Assignee: Sargent & Greenleaf, Inc., Nicholasville, Ky.

[21] Appl. No.: 237,983

[22] Filed: Feb. 25, 1981

[51] Int. Cl.[3] ..... E05B 29/08

[52] U.S. Cl. ..... 70/366; 70/464

[58] Field of Search ..... 70/366, 354, 364 R, 70/364 A, 455, 463, 464, 461, 431

[56] References Cited

U.S. PATENT DOCUMENTS

| | | | |
|---|---|---|---|
| 1,154,078 | 9/1915 | Upton | 70/464 |
| 4,069,693 | 1/1978 | Spalding | 70/455 |
| 4,267,717 | 5/1981 | Marfikainen | 70/366 |

*Primary Examiner*—Robert L. Wolfe

*Attorney, Agent, or Firm*—Mason, Fenwick & Lawrence

[57] ABSTRACT

A key operated rotary core cylinder lock having rotary disc tumblers arranged in a pack with intervening spacer members within a rotary core sleeve normally held against rotation within the lock casing by a locking bar which spans the shear line between the disc tumbler peripheries and the confronting wall of the rotary core sleeve or shell. Gates are provided in the disc tumblers to be aligned by an appropriate key with the locking bar for releasing the plug for rotation, and the spacer members are of a truncated triangular cross-sectional configuration having rounded corners bearing against and positioned by the cylindrical bore in the core sleeve and have flat side portions between the rounded corners and larger radius center openings than the radii of the key openings in the disc tumblers to provide spaces for accommodating foreign matter contaminants. Exposed shackle padlocks incorporating such rotary core cylinder lock components are also disclosed.

27 Claims, 9 Drawing Figures

11
11f
11K
17
17
23
24
24a
14
15
16
16a
19
20
21
22
25
26
27
28
29
31a
31b
31c
33
34
35

KEY LOCK CYLINDER FOR POSSIBLY CONTAMINATED ENVIRONMENTS

BACKGROUND AND OBJECTS OF THE INVENTION

The present invention relates in general to cylinder type key locks and locking devices which are environmentally exposed, and more particularly to key operated rotary plug cylinder key locks having rotary disc type tumblers with special provisions to protect the key lock against jamming or faulty operation by dirt, grit, snow, or other foreign matter contaminants when used in possibly contaminated environment installations. A particularly useful application of the key operated cylinder lock is in padlocks designed for remote possibly contaminated environment use such as for locking railroad switches and security covers in remote, unsupervised locations.

One of the common types of key locks which have come into wide use is the type known as a cylinder lock. Conventional cylinder locks normally comprise a relatively fixed housing forming the lock body or casing having a cylindrical bore opening through the front surface of the lock body which rotatably houses a rotating cylinder or plug assembly. The rotatable cylinder or plug assembly has a keyway or key slot opening through the front surface of the cylinder or plug and extending over most of the axial length thereof, as well as one or more resiliently urged tumblers formed of rotatable or slideable members which normally occupy positions crossing the shear zones or interface zones at boundries between the rotatable cylinder core or plug and the outer body or shell preventing rotation of the core relative to the body or shell. When a key of proper contour or combination surfaces inserted in the keyway or key opening in the cylinder core or plug, the contoured key surface aligns the resiliently urged tumblers in such a way that a parting line, either of the tumbler members or of some other locking member coactive with the tumbler members, is brought into coincidence with the interface plane at the shear zone, or the locking member is withdrawn from interference in the path of the interface plane or peripheral surface of the core or plug, so that when all of the tumblers are properly aligned by the contoured key surface, rotational forces applied to the key permit the core or plug to turn through the normal motion involved in moving the lock, from a locked to an unlocked condition.

Heretofore, rotary disc tumbler cylinder key locks having a plurality of rotary disc tumblers provided with peripheral gates which, when properly aligned by the correct key with a locking rod or bar which normally spans across the shear zone between the rotary cylinder core and the housing or shell, of a type which may be desirable for use in padlock installations, have been disclosed in earlier U.S. Pat. Nos. 4,008,588 and 4,062,211 to Harry C. Miller et al and 4,083,212 assigned to the assignee of the present application. The disc tumbler key locks of Oy Watsila Ab U.S. Pat. Nos. 3,771,340 and 3,621,689 are of similar construction. However, due to the relatively close tolerances between relatively moveable parts frequently encountered in such cylinder locks, such padlocks are subject to contamination and possible jamming by small particulate foreign matter, snow, or other environmental contaminants when employed in possibly dirty or polluted environmental installations, such as railroad switch padlock applications and the like. Also, for many padlock applications, it is unnecessary to provide as many rotary disc tumblers as are provided in the cylinder locks disclosed in such earlier patents, and therefore flexibility in the choice of the number of disc tumblers, permitting easy selection during assembly of various numbers of rotary disc tumblers, is desired. Particular problems arise from infiltration of contaminants into the spaces between disc tumblers and into the key openings in the rotary disc tumblers in such applications, unless space is provided into which the contaminants can migrate out of positions where they would interfere with and induce jamming of the normal lock components.

Other objects, advantages and capabilities of the present invention will become apparent from the following detailed description, taken in conjunction with the accompanying drawings illustrating a preferred embodiment of the invention.

Figure 4A:
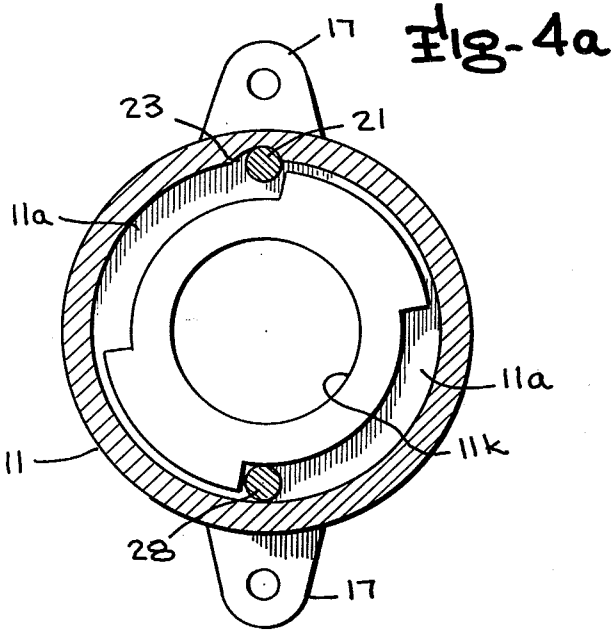
FIG. 4 is a vertical longitudinal section view of the cylinder lock of FIG. 1.
Figure 4:
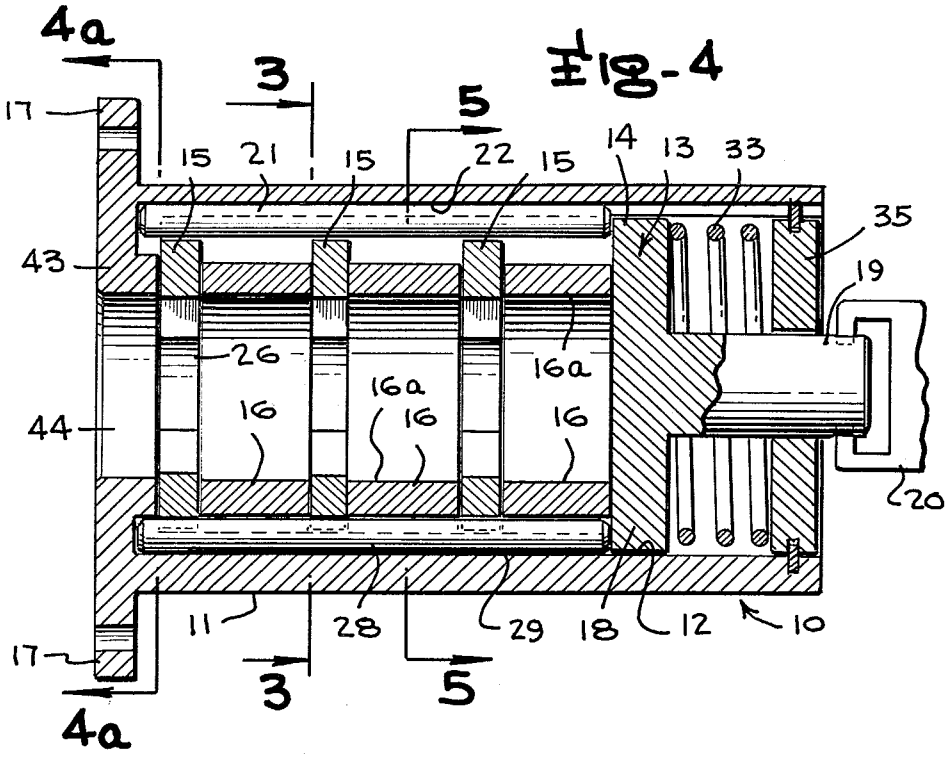
Figure 5:
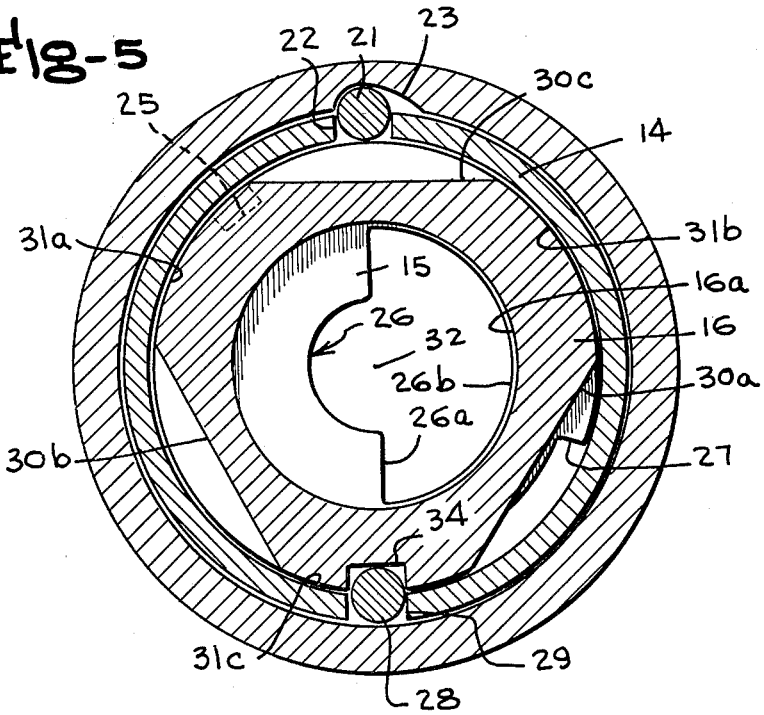
Figures 6, 7, 8:
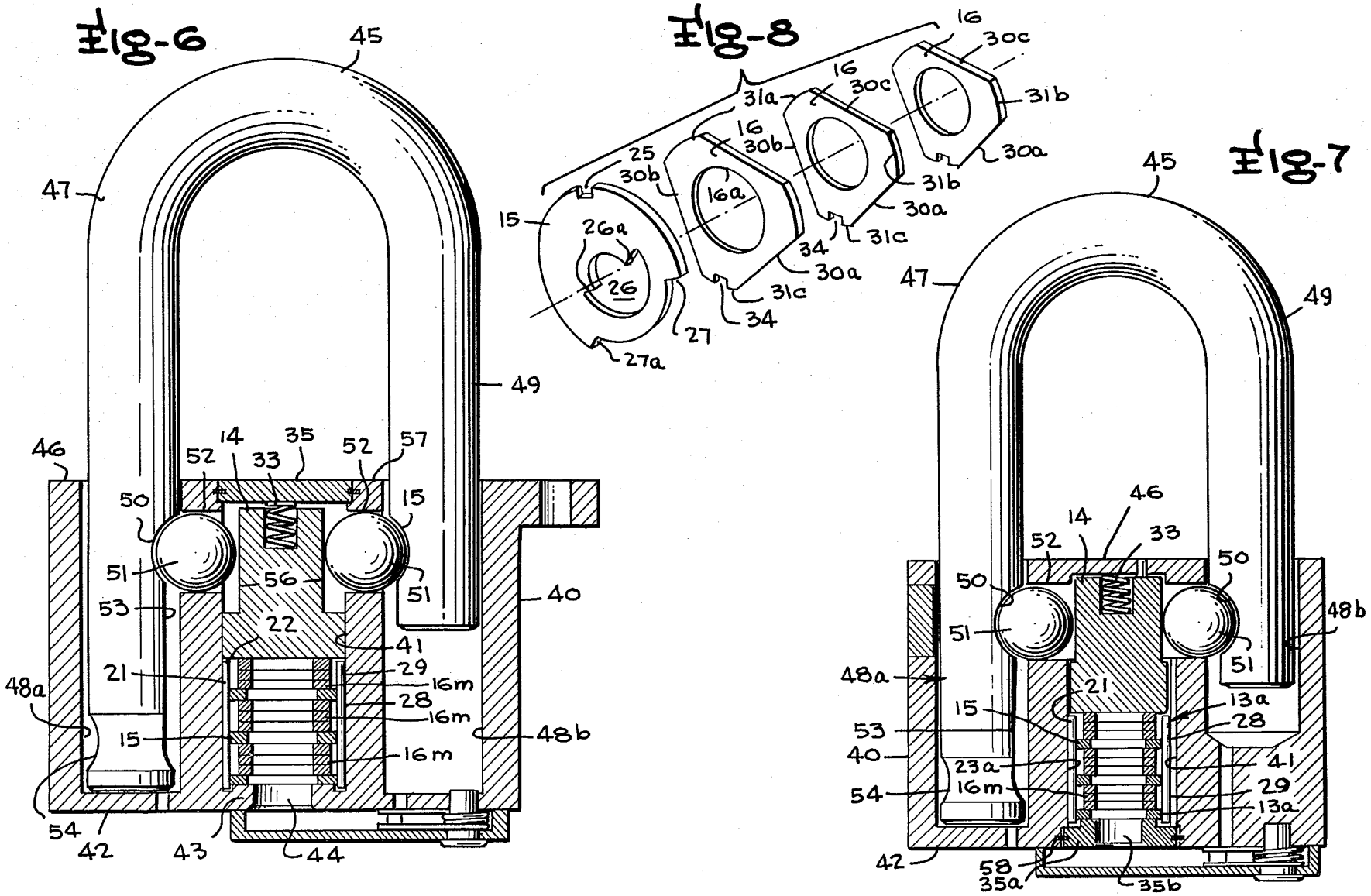

FIG. **4*a* is a vertical section view taken along line 4*a*—4*a* of FIG. 4**;

FIG. 5 is a vertical transverse section view taken along the line 5—5 of FIG. 4;

FIG. 6 is a vertical section view showing the rotary disc tumbler cylinder lock incorporated in a top load padlock assembly;

FIG. 7 is a similar vertical section view showing the cylinder lock incorporated in a bottom load exposed shackle padlock; and FIG. 8 is a perspective view of a disc tumbler and an associated set of three spacer modules as used in the locks of FIGS. 6 and 7.

DETAILED DESCRIPTION OF A PREFERRED EMBODIMENT

Figure 1:
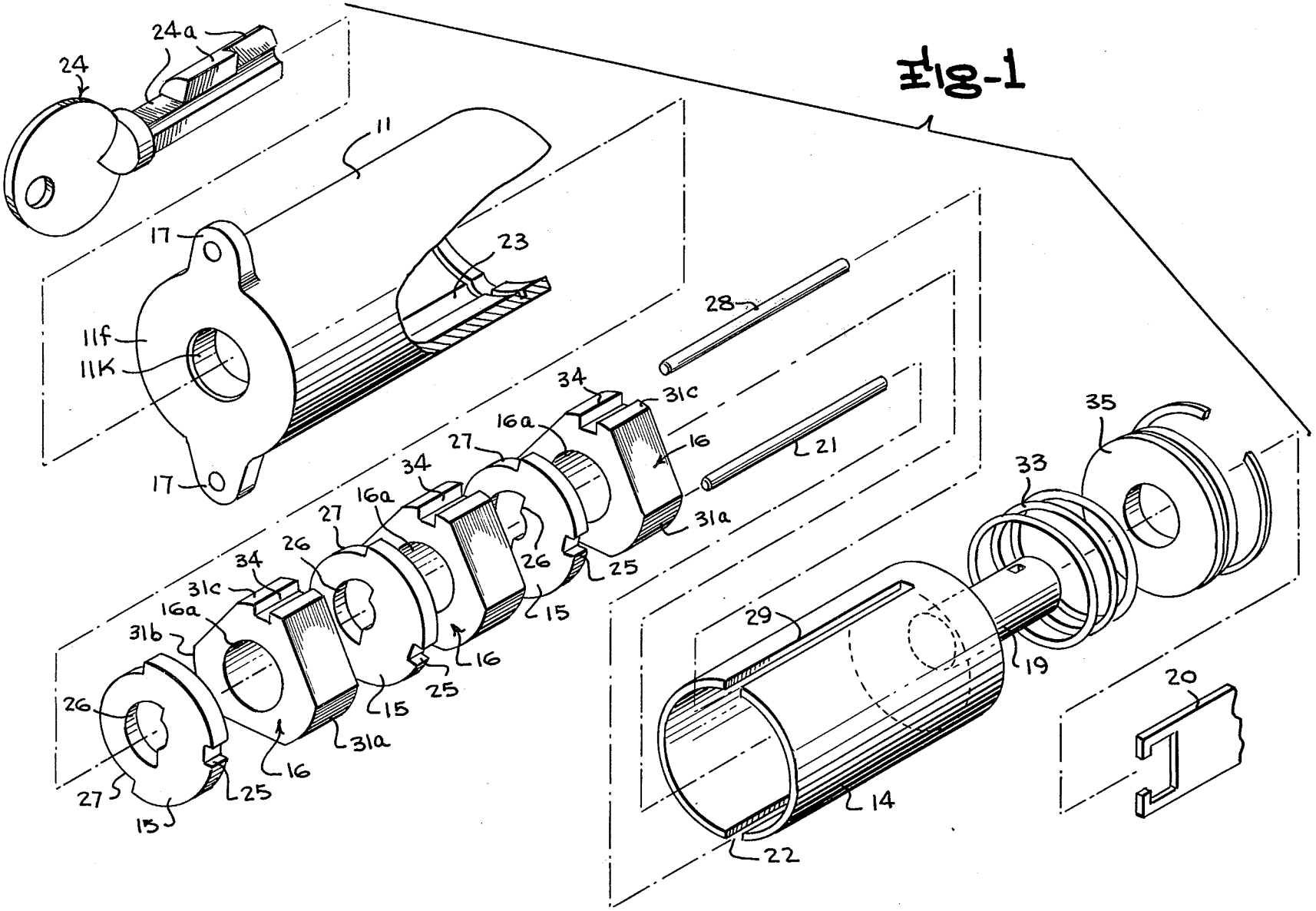
FIG. 1 is an exploded perspective view of a rotary disc tumbler type key lock cylinder or plug embodying the present invention.

Referring to the drawings, wherein like reference characters designate corresponding parts throughout the several figures, the cylinder lock of the present invention is indicated generally by the reference character 10 and comprises a generally cylindrical lock housing or case 11 having a cylindrical bore 12, which may in the preferred embodiment be a rearwardly opening bore, housing a rotatable cylindrical core or plug assembly 13. The rotatable core or plug assembly 13 includes an outer tubular sleeve or shell 14 which encloses a stack of rotatable locking discs or disc tumblers 15 and spacers 16 arranged in a stacked array concentric with the center axis of the shell or sleeve member 14. The lock case 11 in the embodiment illustrated in FIG. 1 is provided with the usual mounting enlargements, such as indicated at 17, having screw holes for mounting the lock case in the door or other body housing the lock assembly, or may be provided with an enlarged cylindrical front flange and a suitable threaded mounting ring or clamping ring of conventional construction. The sleeve or shell member 14 of the FIG. 1 embodiment includes a rear wall 18 of circular cross-sectional profile sized to closely fit within the rearwardly opening bore 12 of the case 11, and may be provided, in one example, with an integral boss or coupling formation 19 for mounting the usual connecting bar 20 coupled to a conventional latch bolt or the like to be locked and unlocked by the key lock core or plug cylinder when the latter is rotated from locked to unlocked position upon insertion and rotation of the proper key.

Figure 2:
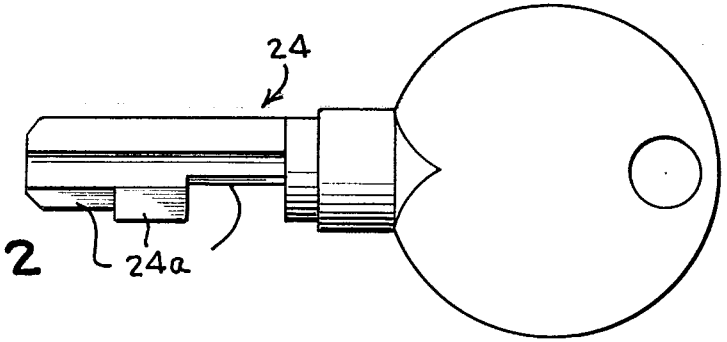
FIG. 2 is a side elevation view of a typical key for unlocking the lock.

In the normal condition of the lock without the proper key being inserted, the sleeve or shell member 14 of the plug or core assembly 13 is fixed against rotation relative to the lock case 11 by means of a locking bar or pin 21 extending parallel to the axis of the plug or core assembly 13 and positioned so that it is partially located in an axial groove 22 in the inwardly facing surface of the case 11 and partially in an axial slot 23 in the wall of the sleeve or shell member 14 of the core so as to span the shear line between them. The rotary disc tumblers 15 in the described embodiment, three of which are provided in the illustrated example, have a slightly greater than semicircular center opening 26 similar to the semicircular center openings in the locking disc tumblers of the previously identified earlier Miller and Tickel or Profrock patents to operate with one or more keys of a slightly greater then semicircular cross-section, as illustrated in FIG. 2 and indicated by reference character 24, cut in accordance with a predetermined key code to provide a combination surface 24*a* having combination values at various incremental step angles, and the peripheral portions of the locking disc tumblers 15 are provided with outwardly opening gates 25 to be radially aligned with the axial slot 23, axial groove 22 and locking bar or locking pin 21 when the appropriate key is inserted in the keyway defined by the center openings 26 and is rotated through an appropriate angle, for example 90°, in the proper direction. Such alignment of the disc tumbler gates 25 with the axial slot 23 and axial groove 22 provides a space to receive the thickness of the locking bar or locking pin 21, permitting it to be cammed into the tumbler gates 25 when a torque is transmitted to the shell or cylinder member 14 by turning of the key further in the same direction, thereby permitting the core or plug assembly 13 to be rotated to unlocking position.

Figure 3:
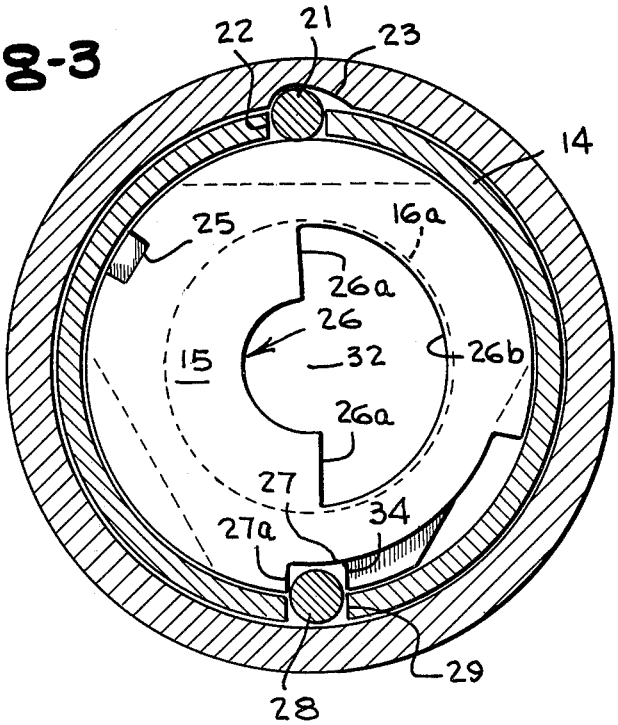
FIG. 3 is a vertical transverse section view of the cylinder lock, taken along the section plane indicated at 3—3 of FIG. 4.

The rotatable disc tumblers 15 are rotatable between a zero position, shown in FIG. 3, in which the insertion and removal of the key is possible, and an angularly displaced position, called a release position, in which the tumbler gates 25 are lined up to receive the locking bar or locking pin 21, and the location of these tumbler gates 25 in the rotary disc tumblers 15 determines the combination value of each rotary disc tumbler, as this is the angle the disc tumbler has to be turned from its zero position to its releasing position by the key. The operating key, as indicated at 24, is provided with a contoured or combination surface 24*a* for each locking disc so that when the key is turned, its combination surface 24*a* engages the straight surface 26*a* of the disc tumblers and rotates the disc tumblers through the proper angles so that the tumbler gates 25 are all brought into releasing position aligned with the locking bar 21.

Each of the disc tumblers 15 are also provided with a circumferentially elongated recess, indicated at 27, which receives a portion of an alignment pin 28 located and partially received in an elongated groove or slot 29 in the shell or sleeve member 14 located diametrically opposite the slot 23 and paralleling the center axis of the core or plug assembly 13. The alignment pin 28 abuts the shoulder 27*a* of the alignment recesses for each of the rotary disc tumblers 15 when they are returned to the zero position by rotation of the key to the zero or insertion position, thus locating the disc tumblers 15 at their properly normally scrambled conditions disposing their gates 25 out of alignment with each other and out of alignment with the locking pin 21. Both the pins 21 and 28 project at their forwardmost ends into arcuate rotation limiting grooves 11*a* in the front end face 11*f* of the case to prohibit overtravel during the operation of unlocking.

Between the successive rotary disc tumblers 15 are specially designed spacers 16, which are of rounded-corners or truncated triangular transverse cross-sectional configuration having isosceles triangular flat sides 30*a*,30*b* and 30*c* at the outer perimeter of each spacer 16 interconnected by convex arcuate or rounded corners 31*a*,31*b* and 31*c* all concentric with the center axis of the spacer, indicated at 32, and all lying in a cylindrical path of a single predetermined radius about the center axis 32 which closely approximates the radius and cylindrically curved path of the inwardly facing surface of the shell or core member 14. This inner surface of the shell or core member 14 of the lock forms the bearing surface for the convex arcuate curved corner segments 31*a*,31*b* and 31*c* of the spacers as well as the outer, maximum diameter perimeter of the rotary disc tumblers 15. The spacers 16 also each include a circular bore or center opening 16*a* having a diameter somewhat greater than the diameter of the substantially semicircular concave curved boundry 26*b* of the disc tumbler key openings 26, and also include an outwardly opening recess 34 of substantially rectangular cross-section to register with and receive the aligning pin 28 which also is received in the aligning recesses 27 of the disc tumblers 15, to maintain the angular positions of the spacers 16 coordinated with each other and eliminate transfer motion of the disc 15 during operation. The provision of the spacer center openings or bores 16*a* of larger radius than the radius substantially semicylindrical convex curved surface of the key bit portion 24*a* provides a spacing between these two surfaces for movement of the environmental contaminants such as dust, dirt, grit, snow and other foreign matter to prevent jamming of the lock components in this region, and the provision of the isosceles triangular flat sides 30*a*,30*b* and 30*c* on the outer surfaces of the spacers form flats along chords of the circular path defined by the cross-section of the cylindrical inner surface of the shell or core member 14 also provides space for accommodating the foreign matter contaminants in these zones to prevent jamming of the locked components.

The spacers 16 of the present invention may, in one preferred form, take the form of a spacer which is of about three times the axial thickness of the rotary disc tumblers 15, assuming, for example, three disc tumblers are to be used, in the form illustrated in FIG. 4, or alternatively may be made-up of modules 16*m*, of identical cross-sectional shape arranged in a stack of, for example, three spacer modules of an axial thickness corresponding to that of the disc tumblers 15, as illustrated in FIGS. 6, 7 and 8. In one illustrative example, wherein the axial thickness of the spacer 16 approximates three times the thickness of each rotary disc tumbler 15, the radius of the convex arcuate corners 31*a*,31*b* and 31*c* may be about 0.304 inch, the diameter of the center hole or bore 16*a* may be about 0.385 inch, the three sides 30*a*,30*b* and 30*c* may be cut on angles of 120° from each other and at spacings of about 0.244 inches along the altitude from the center axis 32 perpendicular to and intersecting the midpoint of the flat side 30*a*,30*b* or 30*c* and the axial thickness may be about 0.176 inch.

The entire stack of rotary disc tumblers 15 and spacers 16, whether of the integral spacer type or of the plural module spacer type, are maintained in resilient compressed state within the bore of the shell or cylinder member 14 by a coil spring 33, which in the FIGS. 6 and 7 applications, is received in a suitably shaped recess in the shell or sleeve member 14 and bearing against a retaining wall of the padlock body as a face plate portion 35, and in the FIG. 4 form surrounds the boss 19, to continuously maintain the stack of disc tumblers and spacers under compression. In the FIG. 4 form, the retaining wall 35 is apertured to pass the boss 19 therethrough, and in both the FIG. 4 and FIG. 7 forms, the retaining wall 35 is held in position by a split ring.

An advantageous installation of such a key operated rotary disc tumbler type lock in a padlock to be installed in situations exposed to severe potential contaminated environment applications is illustrated in FIGS. 6 and 7, showing top load and bottom load installations respectively. In the padlock of FIG. 6, the lock components previously described are indicated by the same reference characters used in the earlier description and form a plug or core assembly 13*a* made-up of a shell or sleeve member 14 and the stack array of rotary disc tumblers 15 and spacers 16 or 16*m*. However, the outer lock case 11 is dispensed with as a separate element and incorporated, in effect, in the padlock body 40 as a cylindrical well 41 closed at the bottom 42 of the lock by a wall portion 43 having the key opening 44 therein. The cylindrical wall of the well 41 which corresponds to the inner surface of the lock case 11 in the previously described embodiment, has a shaped slot 23*a* of the configuration illustrated in FIG. 3, which receives a portion of the locking bar or pin 21 therein in the locked condition, while the other approximately half of the thickness of the locking bar or pin 21 extends into the slot 22 of the shell or sleeve member 14. The diametrically opposite portion of the shell or sleeve member 14 has the alignment slot 29 therein as described in the preceding embodiment receiving the alignment pin 28 which extends into the spacer alignment recesses 34 and the alignment recesses 27 of the disc tumblers 15. The usual U-shaped shackle 45 has a U-shaped portion extending from the top wall 46 of the padlock body 40 and includes a longer leg 47 which is axially movable in a socket 48*a* in the lock body and a shorter shackle leg 49 axially movable in and withdrawable from this companion socket 48*b* of the lock body 40. The shackle legs 47 and 49 have concave notches or locking recesses 50 in the inner surfaces thereof facing each other disposed to receive locking spheres or balls 51 which are restrained in cylindrical passages 52 formed about a common horizontal axis parallel to the planes of the top and bottom lock body walls 46 and 42 in the portions of the lock body between the shackle leg sockets 48*a* and 48*b* and the bore or cavity 41 for the key lock mechanism. As will be seen from the drawings, the longer shackle leg 47 also has an axially elongated flat 53 along the inwardly facing portion of the longer shackle leg confronting the adjacent locking sphere or ball 21 to receive the latter in the unlocking position of that locking sphere or ball 51 but terminating a short distance above the bottom of the longer shackle leg 47 to retain the shackle leg against complete withdrawal from its socket 48*a*. The longer shackle leg also has a circumferential concave annular groove 54 communicating with the lower portion of the axially elongated flat 53 providing a recess for receiving the confronting portion of the adjacent locking sphere or ball 51 at the upwardmost or outermost extended position of the shackle 45 to permit rotation of the shackle at a position when the lower end of the shorter shackle leg 49 is withdrawn from its socket 48*b* to shift the shackle to an unlocking position.

The uppermost end portion of the shell or cylinder 14 in this embodiment is of rounded end, substantially rectangular horizontal cross-section having a pair of more widely spaced rounded ends 56 spaced an appropriate distance to locate the locking spheres or balls 51 outwardly away from each other at positions inserting them into locking relation in the notches 50 of the shackle legs, and having more closely spaced sides 57 dimensioned so as to allow the locking balls 51 to approach each other from the FIG. 6 position and withdraw from the locking recesses 50 in the shackle legs. The entire key lock plug assembly of the shell or cylinder member 14, the disc tumblers 15 and spacers 16, and pins or bars 21 and 28 are retained in the cavity 41 in a compressed state by the spring 33 in its well in the cylinder member 14 bearing against the face plate 35, which in this embodiment is a circular face plate or closure cover located between shackle legs 47,49. In this embodiment, the face plate or cover member 35 has a circular outwardly facing groove and its periphery in which a split ring type retaining ring 58 is placed to restrain the face plate or cover member 35 in and flush with the top wall portion 46 of the lock body 40.

The padlock installation illustrated in FIG. 7 is like that of FIG. 6 except that it is of the bottom load type, wherein the cavity 41*a* for the key lock cylinder assembly opens through the bottom wall 42 of the lock body 40 rather than through the top wall 46, and the face plate or cover plate 35*a* is restrained in and flush with the bottom wall portion 42 of the lock body 40 by a similar split retaining ring 58 which interfits into a circular groove or channel in the circular periphery of the face plate 35*a* and a confronting circular recess in the bounding wall of the plug receiving cavity 41 near the bottom 42 of the padlock body 40. Also, in the bottom load form, the face plate 35*a* includes a key opening 35*b* therein shaped to receive the key 24 and admit it into the keyway formed in the midportions of the stack of disc tumblers 15 and spacers 16, and the confronting surface portion of the top wall 46 of case 40 and of core member 14 may be shaped to provide rotation limiting action similar to that provided by grooves 11*a*. Otherwise, the components of the padlock of FIG. 7 correspond to those of FIG. 6 and are identified by the same reference characters.

We claim:

1. A cylinder lock of the rotatable disc tumbler type provided with contaminant accommodating spaces to minimize foreign matter contaminant jamming of relatively movable lock components for use in contaminated environment installations and the like, comprising a stationary lock casing member having a cylindrical cavity therein for accommodating a rotatable core assembly, a rotatable cylinder lock core assembly in said cavity including a tubular cylindrical shell member rotatable in the cavity and having a hollow bore closed by a rear wall, a plurality of rotary locking disc tumblers with a spacer member interposed between each pair of disc tumblers forming a stacked array of tumblers and spacers encircled within said shell member and rotatable about a common axis therein, an elongated locking bar partially lying in a slot in said shell member arranged parallel to the axis of rotation of said disc tumblers adjacent the periphery thereof normally restrained by the disc tumblers in a position traversing the shear line between the shell member and the casing for locking the shell member against rotation relative to the casing, the disc tumblers being formed with substantially circular body portions having gate recesses of appropriate depth aligned with and adapted to receive the locking bar to accommodate radial inward movement of the locking bar relative to the disc tumblers to positions rotation of the shell member relative to the casing and said tumblers having key openings therein collectively defining a forwardly opening keyway and shaped to be engaged and angularly moved by a key having substantially semicircular cross-section portions inserted therein for aligning the gate recesses with the locking bar, said spacer members having a cylindrical center opening therethrough of predetermined larger radius than the radius of the substantially semicircular key portions providing space therebetween for accommodation of foreign matter contaminants and the spacer members having a substantially circumferentially spaced outer peripheral formation to bear against the walls of said hollow bore and having periphery portions therebetween spaced from the walls of said hollow bore providing foreign matter contaminant accommodating spaces.

2. A cylinder lock as defined in claim 1, wherein said peripheral formations are rounded convex corner formations of the same radis of curvature as the bore of the shell member to engage and be positioned by the walls of said bore.

3. A cylinder lock as defined in claim 1, wherein the outer perimeter of each of the spacer members include three flat wall sections forming said periphery portions lying in an isosceles triangular path extending between the rounded corners along chords of the circular path defined by the bounding wall of said bore.

4. A cylinder lock as defined in claim 2, wherein the outer perimeter of each of the spacer members include three flat wall sections forming said periphery portions lying in an isosceles triangular path extending between the rounded corners along chords of the circular path defined by the bounding wall of said bore.

5. A cylinder lock as defined in claim 1, wherein said shell member includes an elongated alignment member extending inwardly into the tumbler disc accommodating bore, said spacer members each having a notch-like recess receiving said alignment member to maintain the same in alignment with each other and said disc tumblers having circumferentially elongated recesses into which said alignment member extends for aligning the center key openings of the tumblers in predetermined key receiving position.

6. A cylinder lock as defined in claim 2, wherein said shell member includes an elongated alignment member extending inwardly into the tumbler disc accommodating bore, said spacer members each having a notch-like recess receiving said alignment member to maintain the same in alignment with each other and said disc tumblers having circumferentially elongated recesses into which said alignment member extends for aligning the center key openings of the tumblers in predetermined key receiving position.

7. A cylinder lock as defined in claim 4, wherein said shell member includes an elongated alignment member extending inwardly into the tumbler disc accommodating bore, said spacer members each having a notch-like recess receiving said alignment member to maintain the same in alignment with each other and said disc tumblers having circumferentially elongated recesses into which said alignment member extends for aligning the center key openings of the tumblers in predetermined key receiving position.

8. A cylinder lock as defined in claim 1, wherein said shell member includes a second elongated slot diametrically opposite the slot for said locking bar to partially receive an alignment pin therein paralleling the axis of rotation of the disc tumblers and projecting partially into said bore of the shell member, said spacer members having a narrow alignment pin receiving recess in one of the rounded corners of each spacer member receiving the alignment pin to maintain the spacers in predetermined alignment, and the disc tumblers having circumferentially elongated recesses for receiving inwardly projecting portions of the alignment pin having a stop shoulder at one side of such recesses to engage the alignment pin at a predetermined angular position of the disc tumblers disposing their key openings in predetermined key receiving position.

9. A cylinder lock as defined in claim 2, wherein said shell member includes a second elongated slot diametrically opposite the slot for said locking bar to partially receive an alignment pin therein paralleling the axis of rotation of the disc tumblers and projecting partially into said bore of the shell member, said spacer members having a narrow alignment pin receiving recess in one of the rounded corners of each spacer member receiving the alignment pin to maintain the spacers in predetermined alignment, and the disc tumblers having circumferentially elongated recesses for receiving inwardly projecting portions of the alignment pin having a stop shoulder at one side of such recesses to engage the alignment pin at a predetermined angular position of the disc tumblers disposing their key openings in predetermined key receiving position.

10. A cylinder lock as defined in claim 4, wherein said shell member includes a second elongated slot diametrically opposite the slot for said locking bar to partially receive an alignment pin therein paralleling the axis of rotation of the disc tumblers and projecting partially into said bore of the shell member, said spacer members having a narrow alignment pin receiving recess in one of the rounded corners of each spacer member receiving the alignment pin to maintain the spacers in predetermined alignment, and the disc tumblers having circumferentially elongated recesses for receiving inwardly projecting portions of the alignment pin having a stop shoulder at one side of such recesses to engage the alignment pin at a predetermined angular position of the disc tumblers disposing their key openings in predetermined key receiving position.

11. A combination lock as defined in claim 1, wherein said casing is provided with a front wall portion having a key opening therein, and said rear wall being movable axially in said cavity and bearing rearwardly against the stacked array of disc tumblers and spacer members, and the cylinder lock including a spring member bearing against said rear wall resiliently urging the same toward said front wall portion for resiliently compressing the disc tumblers and spacer members together.

12. A combination lock as defined in claim 2, wherein said casing is provided with a front wall portion having a key opening therein, and said rear wall being movable axially in said cavity and bearing rearwardly against the stacked array of disc tumblers and spacer members, and the cylinder lock including a spring member bearing against said rear wall resiliently urging the same toward said front wall portion for resiliently compressing the disc tumblers and spacer members together.

13. A combination lock as defined in claim 3, wherein said casing is provided with a front wall portion having a key opening therein, and said rear wall being movable axially in said cavity and bearing rearwardly against the stacked array of disc tumblers and spacer members, and the cylinder lock including a spring member bearing against said rear wall resiliently urging the same toward said front wall portion for resiliently compressing the disc tumblers and spacer members together.

14. A combination lock as defined in claim 4, wherein said casing is provided with a front wall portion having a key opening therein, and said rear wall being movable axially in said cavity and bearing rearwardly against the stacked array of disc tumblers and spacer members, and the cylinder lock including a spring member bearing against said rear wall resiliently urging the same toward said front wall portion for resiliently compressing the disc tumblers and spacer members together.

15. A cylinder lock as defined in claim 1, wherein said spacer member is of modular form made-up of a plurality of thin spacer members of identical cross-sectional configuration having an axial thickness corresponding substantially to the axial thickness of each said disc tumbler.

16. A cylinder lock as defined in claim 2, wherein said spacer member is of modular form made-up of a plurality of thin spacer members of identical cross-sectional configuration having an axial thickness corresponding substantially to the axial thickness of each said disc tumbler.

17. A cylinder lock as defined in claim 3, wherein said spacer member is of modular form made-up of a plurality of thin spacer members of identical cross-sectional configuration having an axial thickness corresponding substantially to the axial thickness of each said disc tumbler.

18. A cylinder lock as defined in claim 4, wherein said spacer member is of modular form made-up of a plurality of thin spacer members of identical cross-sectional configuration having an axial thickness corresponding substantially to the axial thickness of each said disc tumbler.

19. A key lock as defined in claim 1, including a padlock body encasing said core assembly including said shell member and disc tumblers and forming the casing member therefor, said padlock body having a pair of transversely spaced top opening shackle leg sockets therein extending along parallel axes paralleling the center axis of said disc tumblers and a core cavity therebetween for rotatably housing said core assembly, a U-shaped shackle having a pair of substantially parallel shackle legs normally extending into said sockets and having aligned inwardly facing notches in the confronting faces of the legs lying within the sockets, shackle bolt means extending into said core cavity and into said locking notches in the locking condition of the padlock to lock the shackle legs against withdrawal from their sockets, and said shell member having bolt control means coactive with said bolt means to restrain the bolt means in shackle locking position and release the same to release the bolt means to shackle unlocking position.

20. A key lock as defined in claim 3, including a padlock body encasing said core assembly including said shell member and disc tumblers and forming the casing member therefor, said padlock body having a pair of transversely spaced top opening shackle leg sockets therein extending along parallel axes paralleling the center axis of said disc tumblers and a core cavity therebetween for rotatably housing said core assembly, a U-shaped shackle having a pair of substantially parallel shackle legs normally extending into said sockets and having aligned inwardly facing notches in the confronting faces of the legs lying within the sockets, shackle bolt means extending into said core cavity and into said locking notches in the locking condition of the padlock to lock the shackle legs against withdrawal from their sockets, and said shell member having bolt control means coactive with said bolt means to restrain the bolt means in shackle locking position and release the same to release the bolt means to shackle unlocking position.

21. A key lock as defined in claim 6, including a padlock body encasing said core assembly including said shell member and disc tumblers and forming the casing member therefor, said padlock body having a pair of transversely spaced top opening shackle leg sockets therein extending along parallel axes paralleling the center axis of said disc tumblers and a core cavity therebetween for rotatably housing said core assembly, a U-shaped shackle having a pair of substantially parallel shackle legs normally extending into said sockets and having aligned inwardly facing notches in the confronting faces of the legs lying within the sockets, shackle bolt means extending into said core cavity and into said locking notches in the locking condition of the padlock to lock the shackle legs against withdrawal from their sockets, and said shell member having bolt control means coactive with said bolt means to restrain the bolt means in shackle locking position and release the same to release the bolt means to shackle unlocking position.

22. A key lock as defined in claim 8, including a padlock body encasing said core assembly including said shell member and disc tumblers and forming the casing member therefor, said padlock body having a pair of transversely spaced top opening shackle leg sockets therein extending along parallel axes paralleling the center axis of said disc tumblers and a core cavity therebetween for rotatably housing said core assembly, a U-shaped shackle having a pair of substantially parallel shackle legs normally extending into said sockets and having aligned inwardly facing notches in the confronting faces of the legs lying within the sockets, shackle bolt means extending into said core cavity and into said locking notches in the locking condition of the padlock to lock the shackle legs against withdrawal from their sockets, and said shell member having bolt control means coactive with said bolt means to restrain the bolt means in shackle locking position and release the same to release the bolt means to shackle unlocking position.

23. A key lock as defined in claim 11, including a padlock body encasing said core assembly including said shell member and disc tumblers and forming the casing member therefor, said padlock body having a pair of transversely spaced top opening shackle leg sockets therein extending along parallel axes paralleling the center axis of said disc tumblers and a core cavity therebetween for rotatably housing said core assembly, a U-shaped shackle having a pair of substantially parallel shackle legs normally extending into said sockets and having aligned inwardly facing notches in the confronting faces of the legs lying within the sockets, shackle bolt means extending into said core cavity and into said locking notches in the locking condition of the padlock to lock the shackle legs against withdrawal from their sockets, and said shell member having bolt control means coactive with said bolt means to restrain the bolt means in shackle locking position and release the same to release the bolt means to shackle unlocking position.

24. A key lock as defined in claim 19, wherein said shackle bolt means comprises a pair of locking spheres movable toward and away from each other out of and into shackle locking relation in said shackle notches and said bolt control means comprises a rounded end substantially rectangular formation on said rear wall of said shell member interposed between said locking spheres having a larger transverse dimension in one direction forcing said spheres apart into said locking notches and a smaller transverse dimension in another direction accommodating outwardly approaching movement of the spheres to unlocking withdrawal from the locking notches at the unlocking position of the key lock shell member.

25. A key lock as defined in claim 21, wherein said shackle bolt means comprises a pair of locking spheres movable toward and away from each other out of and into shackle locking relation in said shackle notches and said bolt control means comprises a rounded end substantially rectangular formation on said rear wall of said shell member interposed between said locking spheres having a larger transverse dimension in one direction forcing said spheres apart into said locking notches and a smaller transverse dimension in another direction accommodating outwardly approaching movement of the spheres to unlocking withdrawal from the locking notches at the unlocking position of the key lock shell member.

26. A key lock as defined in claim 22, wherein said shackle bolt means comprises a pair of locking spheres movable toward and away from each other out of and into shackle locking relation in said shackle notches and said bolt control means comprises a rounded end substantially rectangular formation on said rear wall of said shell member interposed between said locking spheres having a larger transverse dimension in one direction forcing said spheres apart into said locking notches and a smaller transverse dimension in another direction accommodating outwardly approaching movement of the spheres to unlocking withdrawal from the locking notches at the unlocking position of the key lock shell member.

27. A key lock as defined in claim 23, wherein said shackle bolt means comprises a pair of locking spheres movable toward and away from each other out of and into shackle locking relation in said shackle notches and said bolt control means comprises a rounded end substantially rectangular formation on said rear wall of said shell member interposed between said locking spheres having a larger transverse dimension in one direction forcing said spheres apart into said locking notches and a smaller transverse dimension in another direction accommodating outwardly approaching movement of the spheres to unlocking withdrawal from the locking notches at the unlocking position of the key lock shell member.

* * * * *